US005587729A

United States Patent [19]

Lee et al.

[11] Patent Number: 5,587,729

[45] Date of Patent: Dec. 24, 1996

[54] ROTATABLE SERVICE STATION FOR INK-JET PRINTER

[75] Inventors: Ghai K. Lee, Singapore, Singapore; Masao Gomi, Suwa, Japan

[73] Assignee: Hewlett-Packard Company, Palo Alto, Calif.

[21] Appl. No.: 59,402

[22] Filed: May 11, 1993

[51] Int. Cl.[6] ..... B41J 2/165

[52] U.S. Cl. ..... 347/32; 347/33

[58] Field of Search ..... 347/29, 32, 33, 347/24

[56] References Cited

U.S. PATENT DOCUMENTS

| | | | |
|---|---|---|---|
| 4,853,717 | 8/1989 | Harmon et al. | 347/29 |
| 4,959,673 | 9/1990 | Noda | 347/33 |
| 4,970,534 | 11/1990 | Terasawa et al. | 347/32 |
| 5,027,134 | 6/1991 | Harmon et al. | 347/29 |
| 5,051,761 | 9/1991 | Fisher et al. | 347/33 X |
| 5,146,243 | 9/1992 | English et al. | 347/29 |
| 5,148,203 | 9/1992 | Hirano | 346/139 R |
| 5,155,497 | 10/1992 | Martin et al. | 347/33 |
| 5,257,044 | 10/1993 | Carlotta et al. | 347/32 |

FOREIGN PATENT DOCUMENTS

| | | | |
|---|---|---|---|
| 8193157 | 11/1983 | Japan | 347/32 |
| 62-251145 | 10/1987 | Japan | B41J 3/04 |

*Primary Examiner*—Benjamin R. Fuller
*Assistant Examiner*—David Yockey

[57] ABSTRACT

A motor driven service station is provided which has a base unit that rotates to a selected angular position to present a black wiper or black cap to an ink-jet pen, when a black pen is installed, or a color wiper or color cap to the pen when a color pen is installed. The drive gears include a cam system which moves the base unit along an axis normal to the rotational axis to effect pen capping. Upon capping, a locking arm engages the pen to lock it in the service position.

10 Claims, 7 Drawing Sheets

ROTATABLE SERVICE STATION FOR INK-JET PRINTER

BACKGROUND OF THE INVENTION

1. Field of the Invention

The present invention relates generally to service stations for ink-jet printers and more particularly to such service stations which can be utilized to service either a color pen or a black pen, whichever is installed in the printer.

2. Description of the Related Art

An ink-jet printer includes a replaceable printing cartridge or pen having a printhead formed thereon. The cartridge includes a reservoir of ink which is fired through nozzles in the printhead onto a printing medium such as paper. The structure and operation of such printing cartridges is well-known to those skilled in the art.

Prior ink-jet printers include a service station at one end of the travel path of a printing carriage upon which the printing cartridge is mounted. The service station includes a wiper for wiping the printhead to remove contaminants, dried ink and the like from the printhead surface containing the nozzle openings. Also provided is a cap which covers the printhead when the printer is not printing to prevent the ink in the nozzles from drying. The service station may also include a spittoon into which ink from the nozzles can be fired to clear the nozzles of any viscous ink.

Most prior art ink-jet service stations include a wiper which is fixed on the service station with its tip slightly above the plane of travel of the pen surface. As the pen moves into the service position, it traverses the tip of the wiper thereby wiping the pen surface. Only one wipe is provided each time the pen moves into or out of the service position.

Some ink-jet printers are equipped to print with either black ink, when a black cartridge is installed, or in color ink, when a color cartridge is installed. Because of the differences in color and black cartridges, separate caps and wipers are used to cap and wipe each cartridge. Some prior art ink-jet printers are operable to receive either a black cartridge or a color cartridge and print according to which cartridge is installed. Such printers require a service station which can cap and wipe both types of cartridges. An example of such a service station is disclosed is U.S. Pat. No. 5,146,243 to English, et al for a diaphragm cap system for ink-jet printers, which is incorporated herein by reference. This prior art patent includes a rotatable service station having a color cap and wiper on one side thereof and a black cap and wiper disposed on an opposite side. Each cap is mounted on an associated sled which is loosely clipped onto the service station so as to be retained when the service station rotates 180 degrees to present the other wiper and cap to the print cartridge. Each sled is slidable laterally, parallel to the bidirectional path of the print cartridge, along a cam surface. As the print cartridge moves into the service station at one end of the cartridge travel path, it engages a post on the appropriate sled thereby dragging the sled along the cam surface which causes the same to be urged into capping engagement with the print cartridge.

While the foregoing system provides a very effective service station, it takes up more space than would ideally be used for a service station on a portable printer. It would be desirable to provide a compact service station for a portable printer.

It would be also desirable to provide such a service station which can service both color and black pens.

It would be further desirable to provide such a service station in which the capped position is locked to insure proper capping of the pen when the printer is transported.

It would also be desirable to provide such a printer in which pen wiping can be provided either passively, in response to a pen passing by a fixed wiper, or actively, in response to wiper movement relative to the pen.

It is also desirable to provide such a service station which produces an accurate capping force.

It is further desirable to provide such a service station which includes foam therein for directing ink away from electronic circuitry in the printer.

SUMMARY OF THE INVENTION

This invention concerns a method and apparatus for servicing a pen that is installed in a printer for movement between a printing position and a service position. The apparatus comprises a carrier member upon which a capping member is mounted. The carrier member is rotatable about an axis of rotation for rotating the capping member into and out of a capping position in which the capping member is opposite the pen when the pen is in the service position. The carrier member is shiftable into capping engagement with the pen when the pen is in the capping position.

In one aspect,a plurality of service components are mounted on the carrier including a pair of capping members and a pair of wipers. The carrier is rotatable about the axis of rotation into a selected one of four angular positions for urging one of the service components into contact with the pen when the pen is in the service position.

A method for servicing such a pen in accordance with the invention is also provided.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Turning now to FIGS. 1–6, indicated generally at 10 is a service station constructed in accordance with the present invention.

Figure 2:
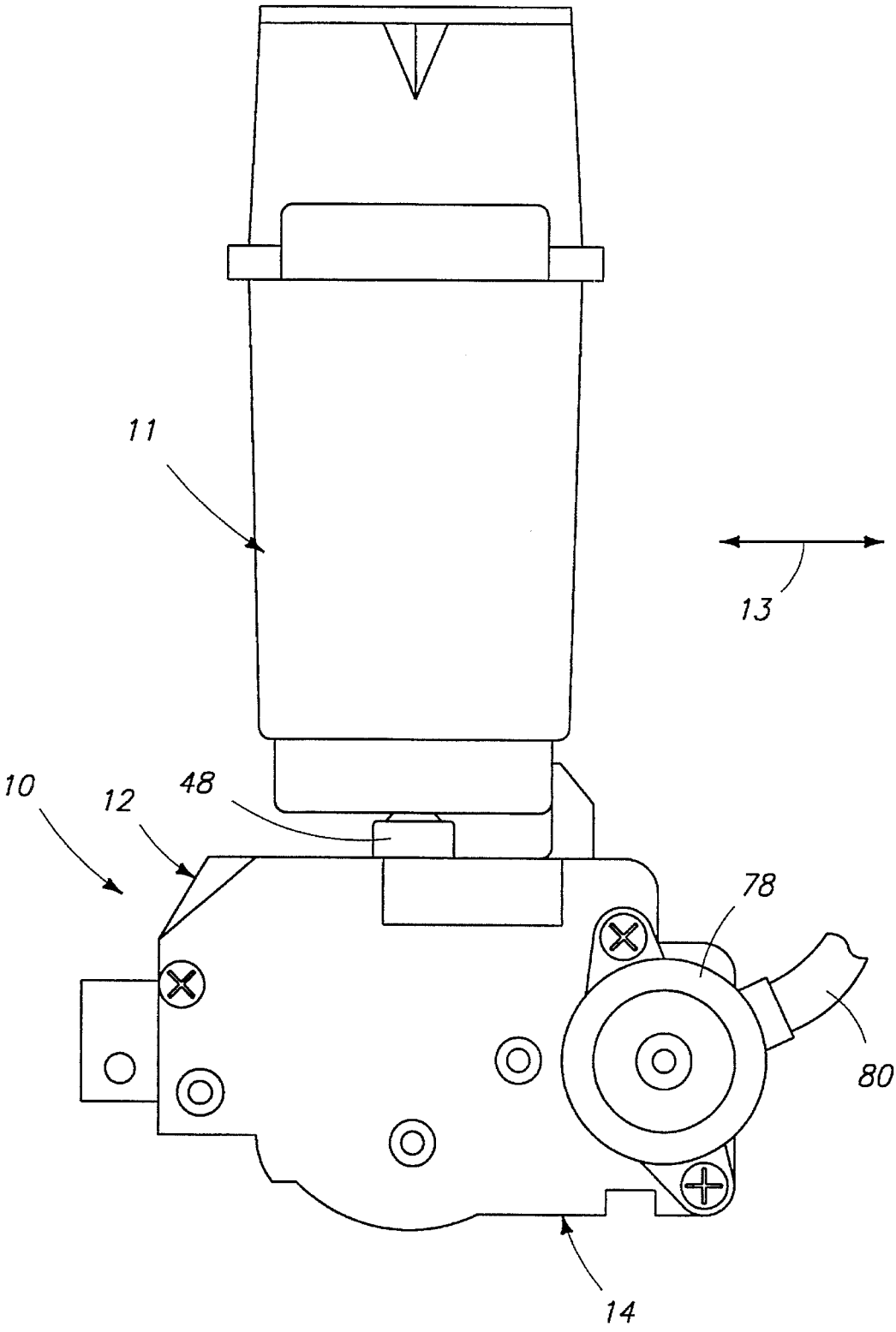
FIG. 2 is an enlarged view taken generally along 2—2 in FIG. 1 and showing a pen in capped engagement with the service station.
Figure 3:
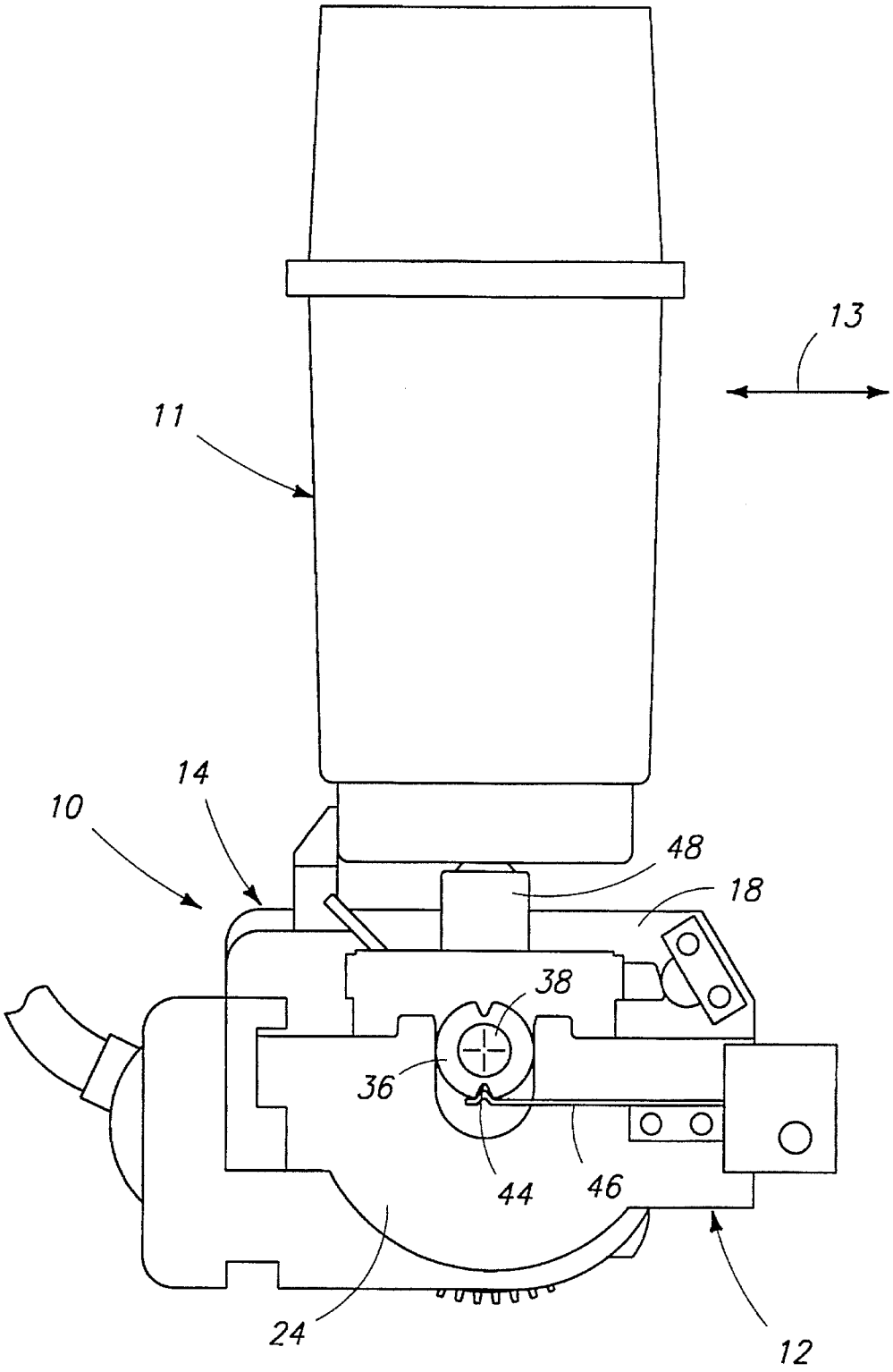
FIG. 3 is a rear elevation view of the structure in FIG. 2 which is generally along 3—3 in FIG. 1.

In FIGS. 2 and 3, an ink-jet cartridge or pen (11) is mounted on a laterally shiftable carriage (not shown) for bi-directionally driving pen (11) along an axis indicated by arrow 13. In the view of FIG. 2, however, pen (11) is driven to a service position which, in the present embodiment of the invention, comprises the left-most position of pen (11) along the travel path. In FIG. 3, the service station and pen are configured the same as in FIG. 2 but are viewed from the rear with pen (11) therefore being in its right-most position in the view of FIG. 3.

Figure 4:
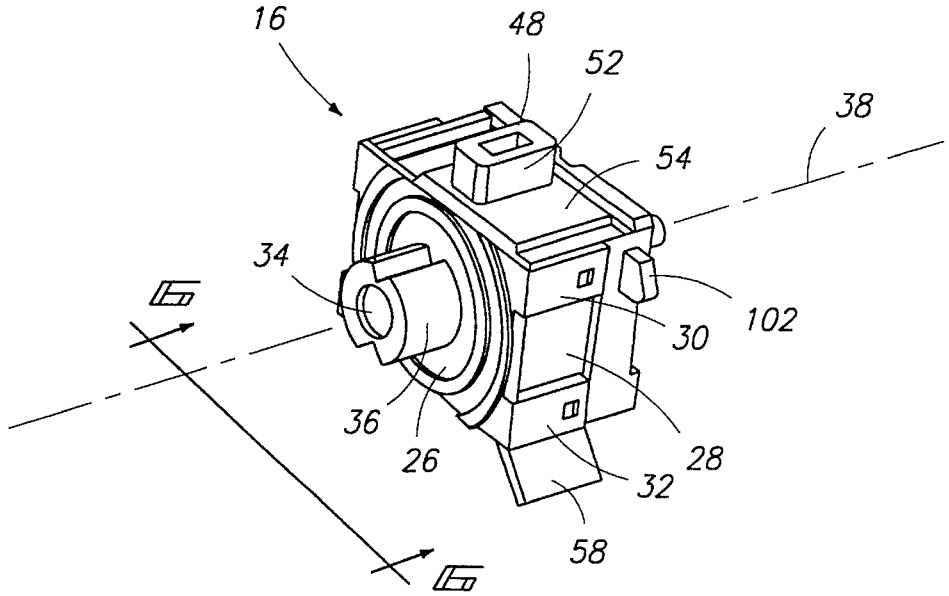
FIG. 4 is a perspective view of the base unit of FIG. 1 having a black cap thereon, also taken generally along 3—3 in FIG. 1.

Service station 10 includes a frame (12), a wall (14) mountable on frame (12) and a base unit (16), such being referred to herein as a rotatable carrier. The frame and wall, as are portions of the base unit as hereinafter described, are formed from a suitable polymeric material. FIG. 4 is a view of base unit (16) by itself as viewed generally along 3—3 in FIG. 1.

Frame (12) includes a first sidewall (18) and a pair of opposed end walls (20,22) which extend at fight angles from sidewall (18). A second sidewall (24) extends between end walls (20,22) with sidewalls (18,24) together with endwalls (20,22) forming an open rectangular frame in which base unit (16) is received.

Base unit (16) is formed generally in the shape of a box having a pair of opposed sidewalls, one of which is sidewall (26) and the other of which is substantially parallel to sidewall (26) and spaced therefrom. Base unit (16) includes a foam block (28) which takes up substantially all of the space between the sidewalls and is contained therebetween by end brackets (30,32) on one end and a similar pair of brackets (not visible in FIG. 4) on the other end. A substantially cylindrical portion (34) of foam extends from the block and is received within an axle end (36) which is fixedly mounted on sidewall (26). Axle end (36) is coaxial with an axis of rotation (38). A second axle end (40), (viewable in FIG. 5) extends from the sidewall of base unit (16) opposite sidewall (26) and is also fixedly mounted on the sidewall. Axle end (40) includes a driven gear (42) which is fixed on the axle coaxially with axis (38). Thus, when rotational force is applied to one of the axle ends on base unit (16), the entire base unit rotates.

Axle end (36) includes a pair of opposed notches (43,44 in FIG. 6) which are engageable with a spring (46 in FIG. 3) having one end mounted on a second sidewall (24) of the base unit. The spring and notches thus provide a detent which accurately positions the base unit in preselected locations in a manner of which will be later described.

A black capping member (48) is mounted on one side of base unit (16) and a color capping member (50) is mounted on the other. Each capping member includes an upright elastomeric portion, like portion (52) in capping member (48) (in FIG. 4), which is mounted on upper portion (54) of the base unit. Portion (54) is detachable from the base unit and is detached in the view of FIG. 1 to reveal foam block 28 in that view. Cap (50) is similarly mounted on the underside, as viewed in FIG. 6, of base unit (16). Each portion, like portion (54), upon which a cap is mounted includes a space which is substantially sealed by another elastomeric member (not visible) received in the underside of portion (54). A small hole therein permits ink to drain from the interior of the capping member into foam (28).

First and second elastomeric wipers (56,58) are mounted on base unit (16). Wiper 56 is designed to wipe a color pen and wiper 58 is designed to wipe a black pen. Each wiper includes a triangular base portion (not visible) which is received in a slot having a triangular cross-section formed in the base unit to secure the same therein. Other methods for mounting the wipers on the base unit are equally feasible.

Figure 1:
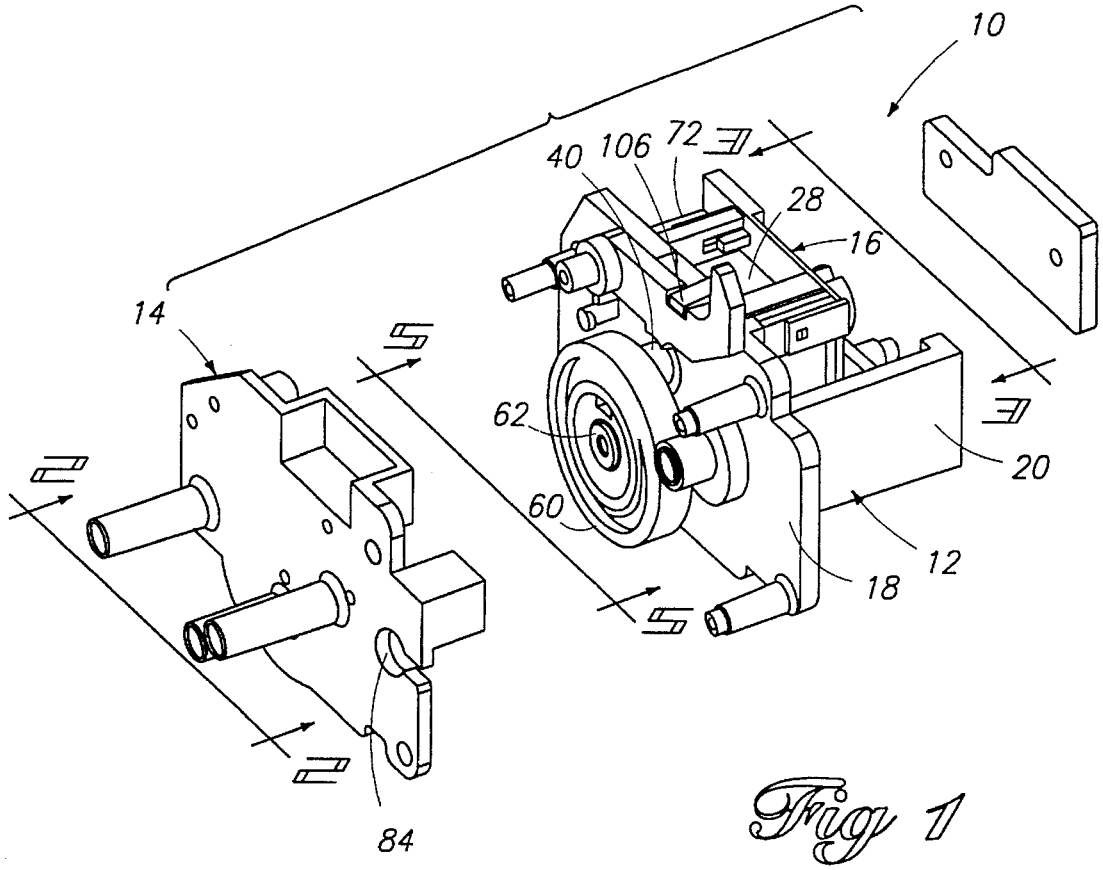
FIG. 1 is a partially-exploded view of a service station for an ink-jet printer constructed in accordance with the present invention with the black cap removed from the base unit.
Figure 5:
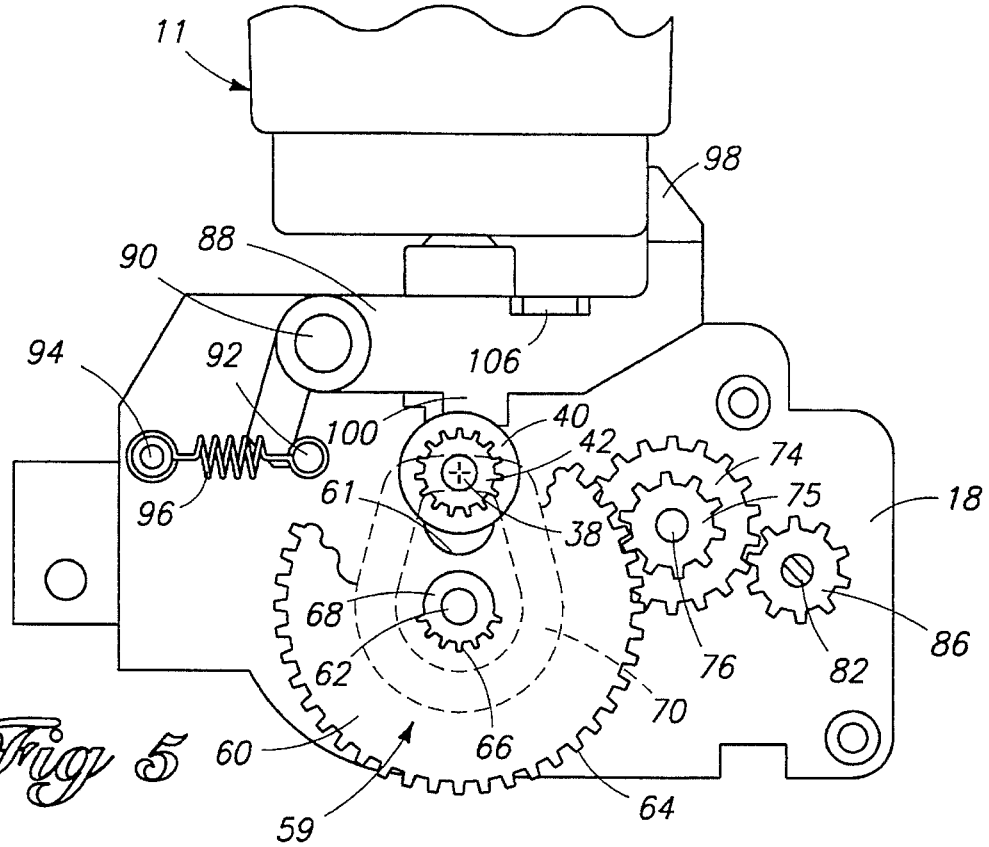
FIG. 5 is a view of the service station and pen configured as in FIG. 2 with a portions thereof broken away to reveal additional detail.

In FIGS. 1 and 5, a drive gear (59) is mounted on an axle (62) which is fixed on wall (18). The drive gear (59) is rotatable about axle (62). The drive gear (59) has a first outer gear (60) and a second inner gear (68) which is integrally molded and coaxial with the outer gear (60). A first, partial circular gear track (64) is formed about an outer circumference of the outer gear (60). A second, partial circular gear track (66) is formed about a portion of the circumference of the inner gear (68). Gear (68) is formed between the outer gear (60) and sidewall (18) in FIG. 5 but is shown in solid lines in FIG. 5 as gear (60) is treated as being transparent therein to reveal features behind the gear. Included on the surface of gear (60) facing sidewall (18) is a cam track (70). Axle end (40) is received within cam track (70) as shown. A slot (61) is formed in sidewall (18) and communicates with an upper edge thereof thus permitting vertical movement of axle end (40), and thus base unit (16), in the view of FIG. 5.

Another gear (74) is rotatable about an axle (76), which is mounted on sidewall (18) in the same fashion as axle (62). A gear (75) is integrally molded with gear (74) coaxially with axle (76). Thus, both gears are rotatable together about axle (76). In FIG. 2, a bi-directional electric motor (78) is mounted on wall (14) and includes a cable (80) which is connected to a conventional circuit for driving the motor in either clockwise or counterclockwise directions. Motor (78) includes a shaft (82) (in FIG. 5) which extends through wall (14) via a slot (84) (in FIG. 1). A gear (86) is fixedly mounted on shaft (82). Thus, whenever motor (78) rotates shaft (82), gear (86) engages with and turns gear (74), and thus gear (75). Gear (75), in turn, engages with and drives gear (60) and thus gear (68). This entire gear train can be so rotated responsive to either clockwise or counterclockwise rotation of motorshaft (82).

A locking arm (88) is pivotedly mounted on a shaft (90) which is integral with and extends from first sidewall (18). The locking arm includes a post (92) which extends therefrom and is integral therewith. Another post (94) extends from wall (18). Posts (92,94) have the ends of a spring (96) connected thereto. Locking arm (88) is thus biased to rotate clockwise around shaft (90) in the view of FIG. 5. The locking arm includes an upright portion (98) which is received along one side of pen (11) when the pen is in its service position and arm (88) is pivoted around shaft (90) to the position shown in FIG. 5. A lower portion (100) of the locking arm rides against axle end (40) and biases the same downwardly within slot (62).

Figure 6:
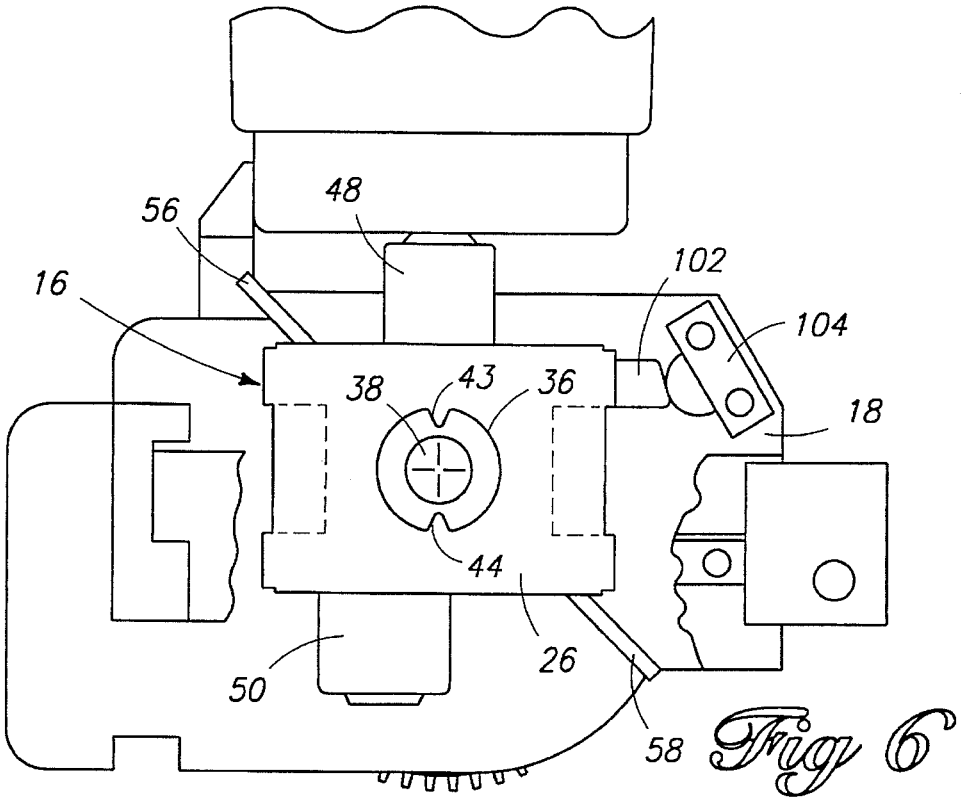
FIG. 6 is a view of the service station and pen as configured in FIG. 3 with portions thereof broken away to reveal additional detail and illustrates the base unit as viewed generally along line 6—6 in FIG. 4.

In FIGS. 4 and 6, a switch lever (102) is integral with and extends from one side of base unit (16). Switch lever (102) actuates a switch (104) which is mounted on sidewall (18)

when base unit (16) is in the position illustrated in FIGS. 5 and 6. The switch provides a signal to control circuitry (not shown) for motor (78) which does not comprise part of the present invention.

In operation, as previously mentioned, in the view of FIGS. 2 and 3, pen (11) is in a service position immediately above service station (10), which is located at one end of the travel range of pen (11). The pen includes a disposable cartridge having an ink reservoir therein. In the present embodiment of the invention, pen (11) may comprise a black ink cartridge or a color ink cartridge. Systems are known in the art which sense whether or not a black or color cartridge is installed in a printer which information is used to control the service station in a manner to be hereinafter described. Although the system does not form a part of the present invention, such a system is disclosed in U.S. Pat. No. 5,155,497 for a service station for ink-jet printer issued on Oct. 13, 1992, which is incorporated herein by reference.

When the circuitry controlling the position of pen (11) sends a signal to drive the pen from the service position into a printing position, the signal is also provided via cable (80) to motor (78) to begin causing shaft (82) and hence gear (86) (in FIG. 5) to rotate in a counterclockwise direction. The direction of rotation of each of the gears is illustrated by arrows in FIG. 7. As can be seen in FIG. 5, cam track (70) holds axle end (40) spaced upwardly from gear (68). This defines the uppermost range of travel of axle (40) and hence of rotational axis (38). It can also be seen that locking arm (88) is abutted against a stop (106), also viewable in FIG. 1, which prevents further upward movement of locking arm (88). As gear rotation in the direction of the arrows in FIG. 7 commences, axle end (40) is driven downward by movement of cam track (70) to the position shown in FIG. 7. In this position, the gear (42) begins to engage with gear (68). When these gears engage, gear (68) and the gear on axle end (40) are referred to herein as being in engaged condition. When the gears are not engaged with one another, these gears are referred to herein as being in a disengaged condition.

Figure 7:
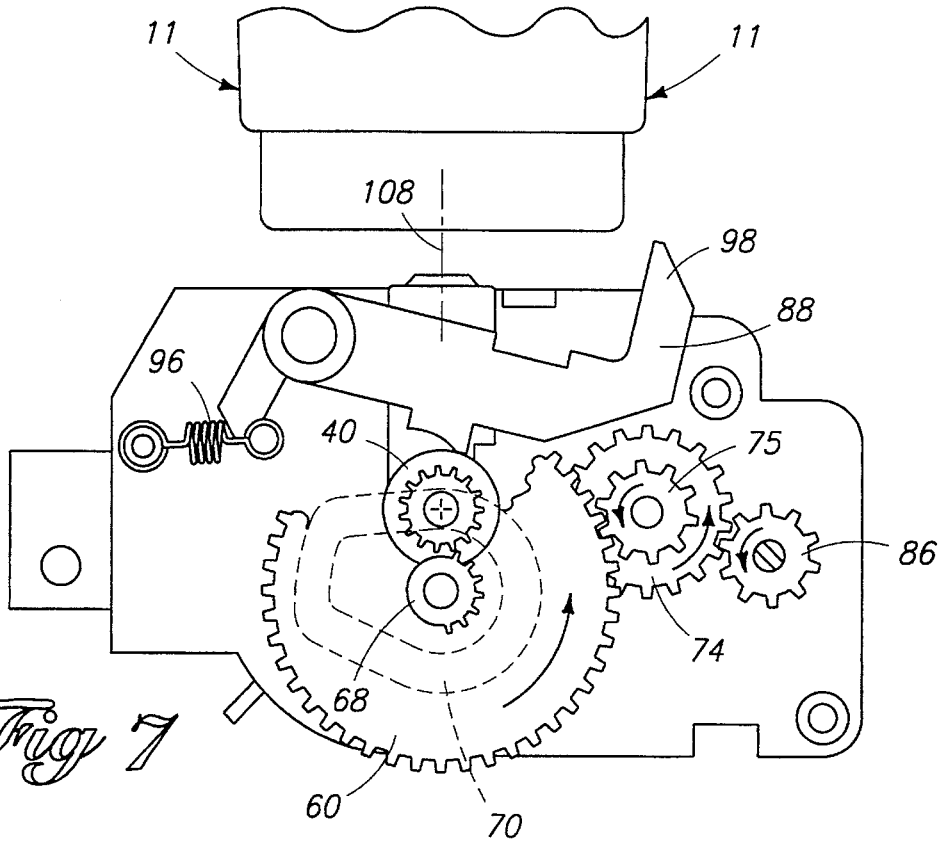
FIG. 7 is a view similar to FIG. 5 illustrating the cap in a lowered position.
Figure 8:
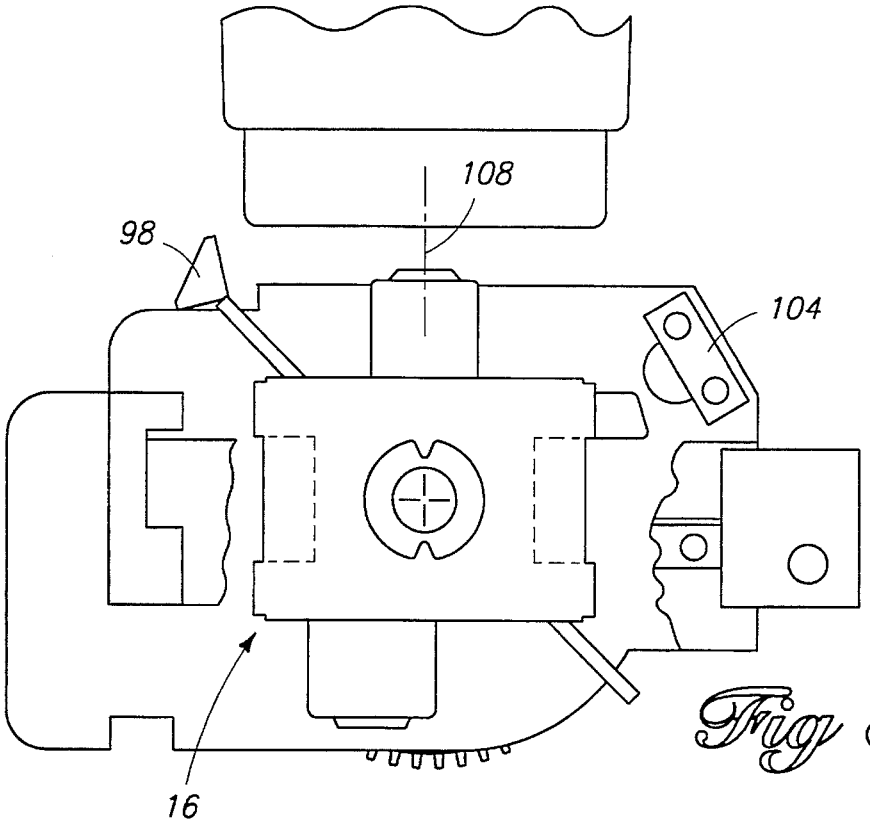
FIG. 8 is a view similar to FIG. 6, illustrating the cap in the same position as FIG. 7.

In FIGS. 7 and 8, an axis (108) illustrates the linear travel path taken by axle end (40), and hence the entire base unit (16), as service station (10) moves from the configuration in FIG. 5 to that illustrated in FIG. 7. As can be seen in FIG. 8, switch (104) no longer remains actuated with base unit (16) in a lowered position. Also, spring (96) biases locking arm (88) downwardly, so that it continues to bear against axle end (40). Portion (98) of locking arm (88) pivots away from and beneath pen (11).

Figure 9:
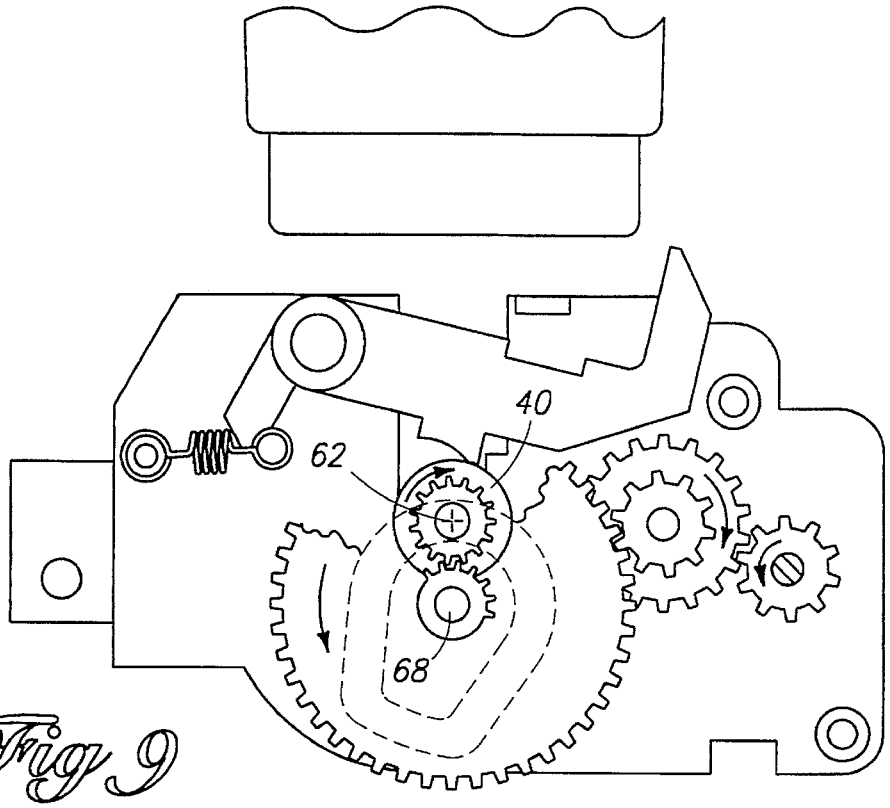
FIG. 9 is a view similar to FIG. 7 illustrating the service station rotated to present the spittoon toward the pen.
Figure 10:
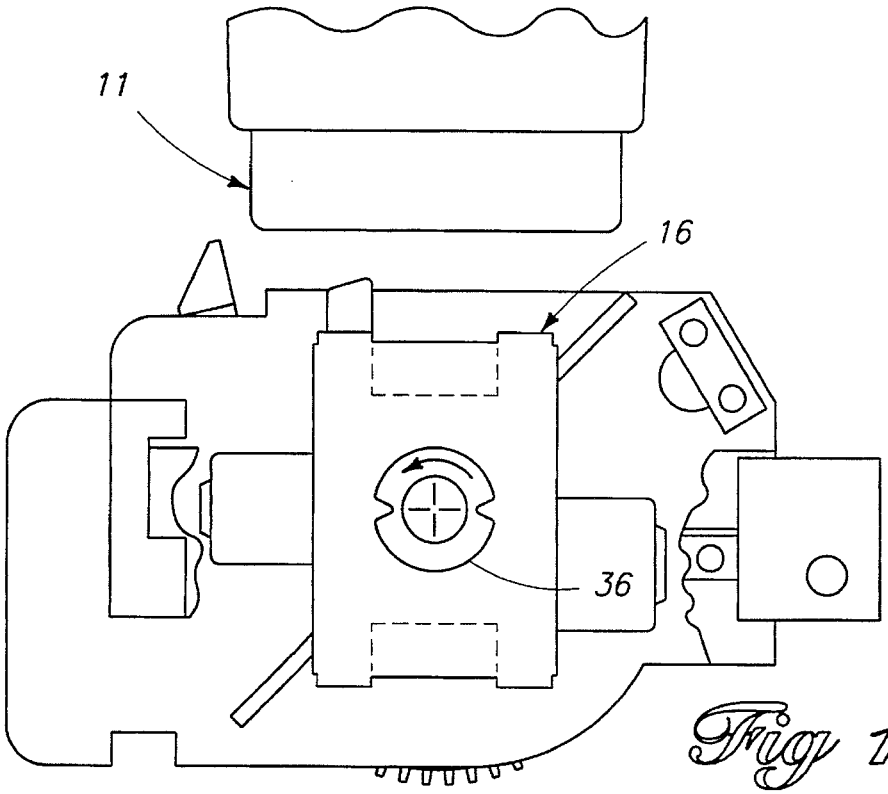
FIG. 10 is a view of the configuration of FIG. 9 from the rear of the service station.

Turning now to FIGS. 9 and 10 illustrated therein is the position to which base unit (16) is driven responsive to further rotation of the gears in the direction of the arrows thereon from the configuration illustrated in FIGS. 7 and 8. Once the gear (42) engages with gear (68), which is just occurring in FIG. 7, additional rotation of gear (68) rotates axle end (40) in the direction shown. FIG. 10 being a rear view of the view of FIG. 9, axle end (36) rotates counterclockwise in the view of FIG. 10. Axle (62) continues to move along cam track (70) from the position shown in FIG. 7 to that of FIG. 9. As can be seen, that portion of cam track (70) in which end (62) is received in FIG. 9 is semi-circular and is spaced away from gear (68) a distance which permits gear (42) and gear (68) to remain engaged as rotation throughout the length of the gear teeth on gear (68).

In the configuration of FIGS. 9 and 10, foam (28) (viewable in FIG. 4), is positioned directly beneath pen (11). In this configuration the foam is positioned to act as a spittoon into which ink from the nozzles in pen (11) can be fired. Such firing may be necessary to clean dried ink from the nozzles, which, although capped, may have been unused a for a time sufficient to permit some ink drying to occur.

Figure 11:
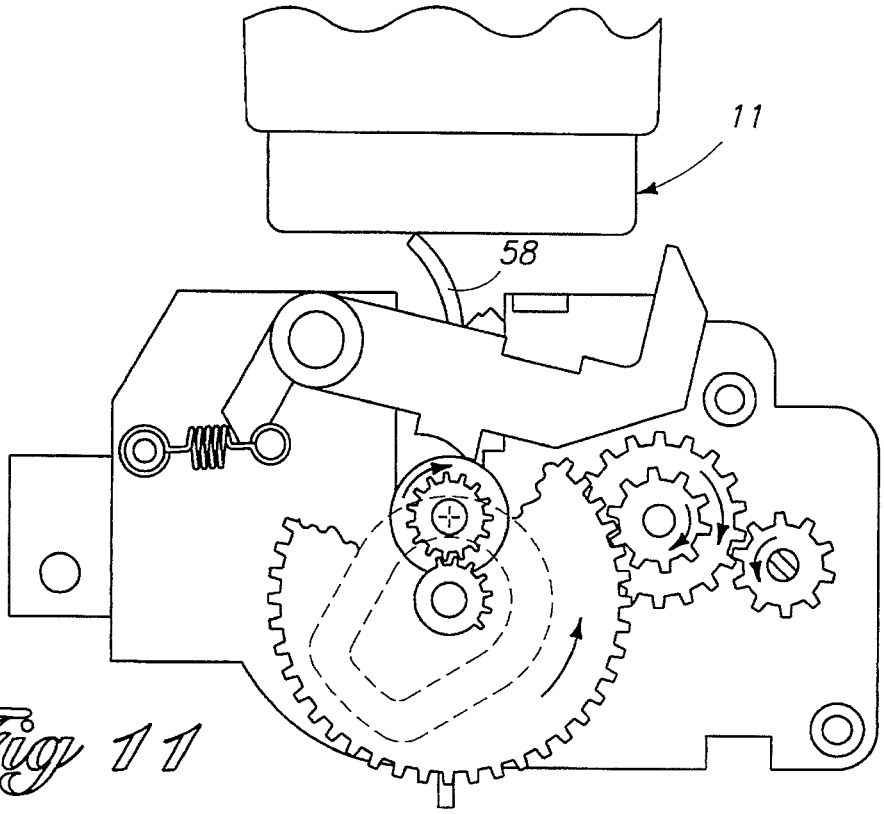
FIG. 11 is a view illustrating the service station configured for wiping the pen.
Figure 12:
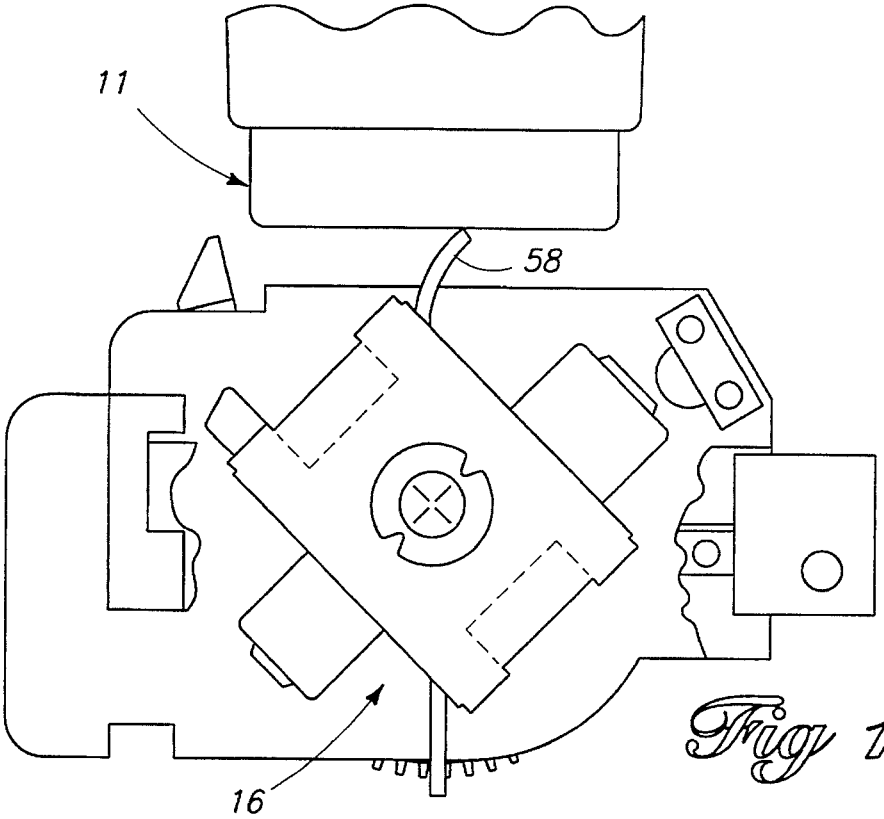
FIG. 12 is a rear elevation view of the configuration of FIG. 11.

Turning now to FIGS. 11 and 12, the service station is shown in the configuration it assumes when still further gear rotation in the direction indicated by the arrows takes place from the configuration illustrated in FIGS. 9 and 10. As can be seen, base unit (16) is pivoted to bring black wiper (58) into contact with the surface on pen (11) in which the nozzles are formed. Further gear rotation from the configuration illustrated in FIGS. 11 and 12 moves the wiper across the surface and wipes any ink or debris that may have accumulated thereon from the surface.

Because motor (78) can be bi-directionally driven, it is possible to actively wipe pen (11) several times by driving the motor back and forth thus running the wiper first in one direction across the pen surface and then in the other until that surface is thoroughly wiped. Alternatively, base unit (16) can remain in position as shown to provide passive wiping on the underside of pen (11), ie, the pen is wiped responsive to pen movement into and out of the service position and not as a result of movement of base unit (16).

After printing, the printer generates a command to drive pen (11) to the service position. The pen is typically again wiped, which can be done either as a result of the pen driving across the tip of wiper (58) while base unit (16) remains fixed in the position illustrated in FIGS. 11 and 12, or can be done be driving motor (78) first one direction and then the other to oscillate base unit (16) in a manner which actively wipes the underside of pen (11) responsive to rotational movement of base unit (16) in both directions. After such wiping, motor (78) is driven in the opposite direction from that depicted in the drawings, thus driving base unit (16) first from the position illustrated in FIGS. 11 and 12 to that illustrated in FIGS. 9 and 10. Typically the pen does not fire ink into the spittoon after printing and wiping upon return to the service position. Thus, continued rotation of the gears in the opposite direction from that illustrated in FIGS. 9 and 10 causes base unit (16) to continue rotation in a clockwise direction, as viewed in FIG. 10, until the service station is in the configuration of FIGS. 7 and 8. Further similar rotation of the motor from the position illustrated in FIGS. 7 and 8 to that illustrated in FIGS. 5 and 6 disengages the gear on axle end (40) from gear (68) responsive to movement of the axle end in cam track (70). Such movement raises base unit (16) until switch (104) is actuated at which point motor driving stops, leaving the service station configured as in FIGS. 5 and 6. Axle end (40) urges locking arm (88) upwardly to the position in FIGS. 5 and 6 thereby locking pen (11) in the service position. With the pen at the end of its travel range on one side and prevented from movement by arm (88) on the other, the service station and pen remain locked in the configuration of FIGS. 5 and 6 even after power to the printer is removed. This facilitates maintaining the pen (11) in a capped condition while the printer is transported.

The gears are sized and configured so that one complete rotation of gear (60) drives base unit (16) through an arc of approximately 180 degrees. Thus, when a black pen is installed in the printer, gear (60) is driven by motor (78) back and forth through a 360 degree range to configure the service station as described above. If the black pen is removed and a colored pen is inserted in its place, the printer circuitry detects this responsive to the prior art system referred to above. When such occurs, motor (78) drives gear (60) beyond the 360 degree range which produces the station configurations described above and illustrated in the drawings. This action rotates base unit (16) to position color cap (50) beneath the pen, to wipe the pen surface with color wiper (56) and to permit ink to be ejected into the spittoon on the opposite side of base unit (16) where foam (28) is visible in FIG. 4. Thus, when operating to service a color pen, gear (60) drives through a range of substantially 360 degree which rotates base unit (16) back and forth within a 180 degree range to provide the color capping and wiping functions substantially as described above in connection with the black capping and wiping functions.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

We claim:

1. An apparatus for servicing a pen that is installed in a printer for movement between a printing position and a service position, the apparatus comprising:

a service station located at the service position, the service station having a rotatable carrier with a capping member and a wiper mounted thereon; and a carrier drive subsystem having a driven gear mounted on a displaceable carrier axle that is connected to the carrier, a drive gear, and a cam surface formed on the drive gear, the carrier axle being engaged with and displaceable by the cam surface, the cam surface having a first cam track portion to position the carrier axle in an engaged proximity where the driven gear mounted on the carrier axle engages the drive gear to rotate the rotatable carrier of the service station to position the capping member and the wiper adjacent to the pen and a second cam track portion to displace the carrier axle to a disengaged proximity where the driven gear is disengaged from the drive gear and the service station is moved along a linear path to selectively cover and uncover the pen with the capping member.

2. An apparatus according to claim 1 wherein the carrier drive subsystem has a wall, and the carrier axle has one end fixably mounted to the wall and a second end movably mounted to track the cam surface.

3. An apparatus according to claim 1 wherein the first cam track portion is circular and the second cam track portion is non-circular.

4. An apparatus according to claim 3 wherein the non-circular second cam track portion displaces the carrier axle to disengage the driven gear from the drive gear.

5. An apparatus according to claim 1 wherein the wiper contacts the pen during at least part of the rotation of the carrier.

6. An apparatus according to claim 1 wherein the carrier is rotated about an axis of rotation and the linear path along which the service station is moved is orthogonal to the axis of rotation.

7. An apparatus according to claim 1 adapted for use with two pens installed in the printer, wherein:

the carrier has a second capping member and a second wiper mounted thereon for servicing a second pen installed in the printer; and the carrier drive subsystem rotates the rotatable carrier of the service station to position the second capping member and the second wiper adjacent to the second pen when the second pen is at the service position.

8. A method for servicing a pen that is installed in a printer for movement between a printing position and a service position, the printer having a service station at the service position, the service station having a rotatable carrier with a capping member and a wiper mounted thereon, the printer also having a carrier drive subsystem with a rotating control cam, disengagable gears, and a displaceable carrier axle to support the service station, the displaceable carrier axle being displaceable by the control cam, the method comprising the following steps:

driving the pen to the service position;

rotating the control cam through part of a first region to engage the gears which cause rotation of the carrier to enable the wiper to wipe the pen;

rotating the control cam through another part of the first region with the gears engaged to further rotate the carrier for alignment of the capping member with the pen; and rotating the control cam through the second region to disengage the gears and to displace the carrier axle causing linear movement of the service station to thereby urge the capping member against the pen.

9. A method according to claim 8 further comprising the step of locking the pen in the service position.

10. A method according to claim 8 adapted for use with first and second pens installed in the printer, the rotatable carrier having the capping member and the wiper mounted thereon which constitute a first capping member and a first wiper and further having a second capping member and a second wiper mounted thereon;

driving the first pen to the service position;

rotating the control cam to engage the gears which causes rotation of the carrier to enable the first wiper to wipe the first pen;

rotating the control cam with the gears engaged to further rotate the carrier for aligning the first capping member with the first pen;

rotating the control cam to disengage the gears and to displace the carrier axle causing linear movement of the service station to thereby urge the first capping member against the first pen;

driving the second pen to the service position;

rotating the control cam to engage the gears which causes rotation of the carrier to enable the second wiper to wipe the second pen; rotating the control cam with the gears engaged to further rotate the carrier for aligning the second capping member with the second pen; and rotating the control cam to disengage the gears and to displace the carrier axle causing linear movement of the service station to thereby urge the second capping member against the second pen.

* * * * *